United States Patent [19]

Morino et al.

[11] 4,275,016

[45] Jun. 23, 1981

[54] VARIABLE VENTURI TYPE CARBURETOR

[75] Inventors: Toshiharu Morino, Mie; Masayuki Okamura, Aichi, both of Japan

[73] Assignee: Aisan Industry Co., Ltd., Aichi, Japan

[21] Appl. No.: 78,742

[22] Filed: Sep. 25, 1979

[30] Foreign Application Priority Data

Oct. 27, 1978 [JP] Japan ..... 53-133070

[51] Int. Cl.[3] ..... F02M 5/08

[52] U.S. Cl. ..... 261/44 C; 261/DIG. 67; 123/519

[58] Field of Search ..... 261/DIG. 67, 44 C; 123/519

[56] References Cited

U.S. PATENT DOCUMENTS

| | | | |
|---|---|---|---|
| 3,548,797 | 12/1970 | Hagihara et al. | 261/DIG. 67 |
| 3,618,578 | 11/1971 | Swatman et al. | 261/44 C |
| 3,829,069 | 8/1974 | Hailstone et al. | 261/44 C |

FOREIGN PATENT DOCUMENTS

| | | | |
|---|---|---|---|
| 2534685 | 3/1977 | Fed. Rep. of Germany | 261/DIG. 67 |
| 53-53222 | 5/1978 | Japan . | |
| 704195 | 2/1954 | United Kingdom | 261/44 C |
| 833952 | 5/1960 | United Kingdom | 261/DIG. 67 |
| 1365889 | 9/1974 | United Kingdom | 261/DIG. 67 |

*Primary Examiner*—Tim R. Miles

[57] ABSTRACT

A variable venturi type carburetor incorporating a changeover valve which conducts the fuel vapor in the float chamber either into the internal passage leading to the suction pipe of the carburetor or into the external passage leading to the canister. The changeover valve is actuated via a rod projecting into the intake passage by a suction piston which is displaced according to the amount of air drawn into the engine and which abuttingly contacts the rod. With this invention, an electromagnetic valve employed in the conventional carburetor can be obviated and the structure of the carburetor becomes simple and small.

7 Claims, 1 Drawing Figure

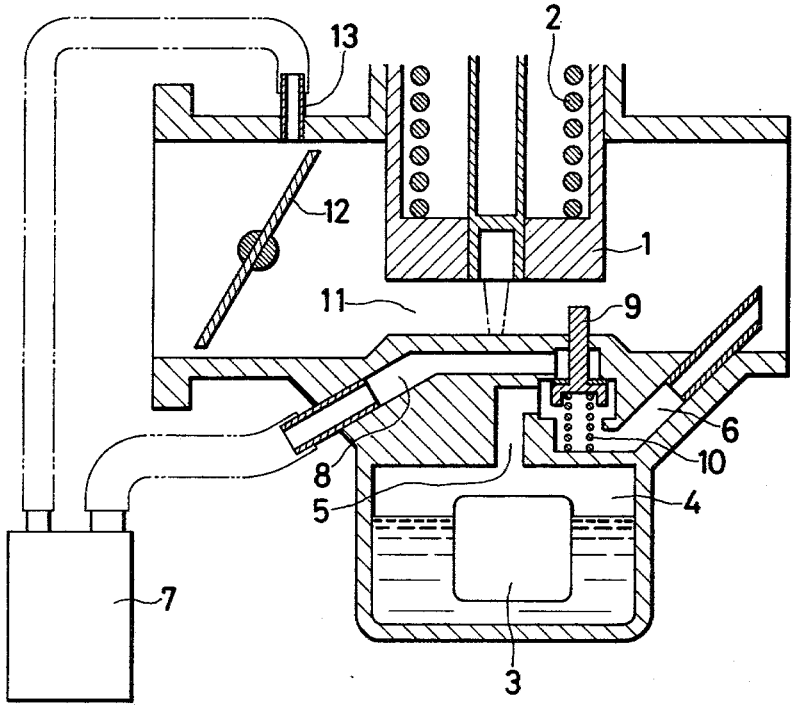
13
2
12
1
11
9
6
10
8
5
4
7
3

VARIABLE VENTURI TYPE CARBURETOR

BACKGROUND OF THE INVENTION

This invention relates to a variable venturi type carburetor. In conventional carburetors an electromagnetic valve is used to change over between an internal passage leading to the suction pipe intake passage downstream of the air cleaner and an external passage leading to a unit outside the carburetor. During the engine operation the fuel vapor in the float chamber is conducted to the internal passage, and to the external passage when the engine is not running. However, the electromagnetic valve presents difficulties in making the carburetor small and light. Thus carburetors employing an electromagnetic valve are necessarily expensive.

SUMMARY OF THE INVENTION

An object of the present invention is to provide a variable venturi type carburetor that can overcome the aforementioned drawbacks of the conventional carburetor. To achieve this objective, the variable venturi type carburetor in which a suction piston is displaced according to the amount of air taken into the engine incorporates a changeover valve having a rod projecting into the intake passage and abuttingly pressed by the suction piston for opening the external passage leading to the canister and for changing over to the internal passage leading to the suction pipe intake passage of the carburetor, whereby the fuel vapor in the float chamber is conducted into either the external or internal passage by the changeover valve which is actuated by the suction piston.

BRIEF DESCRIPTION OF THE DRAWING

The accompanying drawing shows a vertical cross-sectional view of one preferred embodiment of this invention.

DESCRIPTION OF THE PREFERRED EMBODIMENTS

The present invention will now be described with reference to the accompanying drawing.

A suction piston 1 is urged downwardly by a spring 2 and which is of a known construction. When the engine is running the suction piston 1 is lifted and when the engine stops it is lowered. A float 3 is disposed in a float chamber 4 which is formed with a fuel vapor passage 5 which branches into an internal passage 6 communicating with the suction path of the carburetor and an external passage 8 communicating with a charcoal canister 7. At the branch point of the fuel vapor passage 5 a rod valve 9 is arranged so as to be vertically movable and is urged upwardly by a spring 10. When lifted, the rod valve 9 brings the fuel vapor passage 5 into communication with the internal passage 6 and at the same time shuts off the external passage 8. When lowered, it brings the fuel vapor passage 5 into communication with the external passage 8 and shuts off the internal passage 6. The upper end of the projected rod valve 9 has a projecting end portion projecting slightly into the intake passage at the venturi portion 11 of the carburetor in a normal opening condition spaced from and opposite the bottom face of the suction piston 2 and bears against the bottom face of the suction piston 1 when the latter is moved down thereagainst. When the suction piston 1 moves down the rod valve 9 is depressed, and it is reset to the original normal condition position as the piston 1 moves up. A throttle 12 is disposed in the intake passage and a port 13 communicates with the intake passage as well as with the charcoal canister 7 via a line.

Explanation how the carburetor of variable venturi type works follows. When the engine is not running, the suction piston 1 comes down by its own weight and the force of the spring 2 and closes the venturi portion 11, so that the rod valve 9 is depressed downwardly against the force of the spring 10 thereby bringing the fuel vapor passage 5 into communication with the external passage 8 and out of communication with the internal passage 6. At this time, if the pressure of the fuel vapor in the float chamber 4 increases, the fuel vapor passes through the passage 5 and the external passage 8 into the charcoal canister 7, where it is adsorbed by active carbon. When the engine starts running, the suction piston 1 is lifted and separated from the rod valve 9 thereby expanding the venturi portion 11 and allowing the air to be drawn in. As a result, the rod valve 9 is pushed up by the spring 10 shutting off the external passage 8 and opening the internal passage 6, so that the fuel vapor is taken into the engine through the passage 5, the internal passage 6 and the venturi portion 11. As the throttle valve 12 opens, the port 13 is supplied with a negative pressure of the intake passage, which causes the fuel vapor in the charcoal canister 7 to be drawn into the engine through the port 13.

As can be seen in the foregoing, since in this invention the mechanism for controlling the fuel vapor in the float chamber of the carburetor makes use of the suction piston and obviates the conventional electromagnetic valve, the mechanism can be made small and simple and can thereby overcome the drawbacks accompanying the conventional fuel vapor controlling mechanism employing the electromagnetic valve.

What is claimed is:

1. A variable-venturi type carburetor having an intake passage, comprising means comprising a suction piston disposed in said intake passage and adapted to be moved in a path of movement in dependency on the flow rate of intake air sucked into an engine through said intake passage, a canister, a carburetor housing forming an internal passage communicating with said intake passage, a vent passage, a valve chamber communicating with said internal passage and with said vent passage, respectively, and a fuel float chamber communicating with said vent passage and with said valve chamber via said vent passage, means comprising an external passage for communicating said valve chamber with said canister, said internal passage communicating between said valve chamber and the intake passage of said carburetor, means comprising a rod valve disposed in said valve chamber for alternately communicating either said external passage with said vent passage via said valve chamber or said internal passage with said vent passage via said valve chamber depending on predetermined conditions of the engine, and spring means for biasing said rod valve such that said rod valve in normal condition closes communication between said external passage and said vent passage, said rod valve having a projecting end portion projecting into said intake passage spaced from and under said suction piston in the normal condition in the path of movement of said suction piston, said end portion constituting means for being pressed directly by said suction piston only when said suction piston is lowered in a direction opposite to the direction of biasing of said spring means, overcoming the force of said spring means so as to interrupt communication between said internal passage and said vent passage.

2. The variable venturi type carburetor as set forth in claim 1, wherein said suction piston is lowered partly by its own weight.

3. The variable venturi type carburetor as set forth in claim 2, further comprising another spring means for biasing said suction piston in the direction of lowering said suction piston.

4. The variable venturi type carburetor as set forth in claim 1, wherein said end portion is a rod exclusively longitudinally displaceably mounted in said carburetor housing.

5. The variable venturi type carburetor as set forth in claim 1, further comprising a throttle valve disposed in said intake passage downstream of said suction piston, a suction port communicating with said intake passage on a suction side of said throttle valve and with said canister.

6. The variable venturi type carburetor as set forth in claim 1, wherein said housing forms a projection extending into the intake passage on a side opposite to and under said suction piston, the latter having a front face with a diameter substantially equal to the length of said projection, said front face cooperates with said projection forming a venturi portion therebetween and closing the venturi portion when said suction piston is lowered thereto, said projecting end portion of said rod valve projects through said projection at one end thereof slightly into said intake passage in the normal condition.

7. The variable venturi type carburetor as set forth in claim 1, wherein said float chamber is formed substantially directly under said suction piston.

* * * * *